United States Patent [19]

Shamlian

[11] 4,066,077

[45] Jan. 3, 1978

[54] MOUTHPIECE RETAINER TABS

[76] Inventor: Ralph Barr Shamlian, 3549 Haven Ave. No. E, Menlo Park, Calif. 94025

[21] Appl. No.: 737,788

[22] Filed: Nov. 1, 1976

[51] Int. Cl.[2] ..... A62B 7/00

[52] U.S. Cl. ..... 128/145 A; 128/147

[58] Field of Search ..... 128/145 A, 145 R, 147, 128/142.2, 208, 146.7, 136, 145.5, 140 R

[56] References Cited

U.S. PATENT DOCUMENTS

| | | | |
|---|---|---|---|
| 2,317,236 | 4/1943 | Wilen et al. | 128/145 A |
| 2,839,053 | 6/1958 | Lorenz | 128/147 |
| 3,844,281 | 10/1974 | Shamlian | 128/136 |

FOREIGN PATENT DOCUMENTS

| | | | |
|---|---|---|---|
| 927,661 | 5/1947 | France | 128/145 A |

*Primary Examiner*—Robert W. Michell
*Assistant Examiner*—Henry J. Recla
*Attorney, Agent, or Firm*—Strauch, Nolan, Neale, Nies & Kurz

[57] ABSTRACT

A mouthpiece for a snorkel, regulator or other underwater or above water breathing apparatus, having hollow retainer tabs made of pliable material so that the tabs readily collapse to comfortably conform to an approximate dental impression of the user.

6 Claims, 7 Drawing Figures

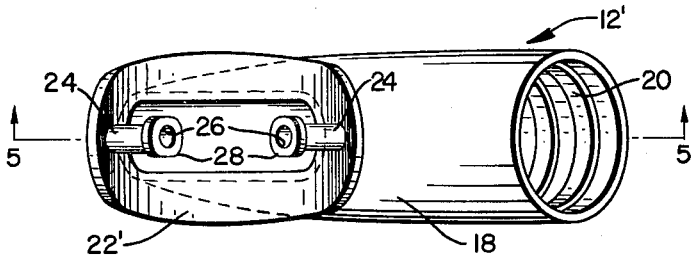
FIG. 4
FIG. 5
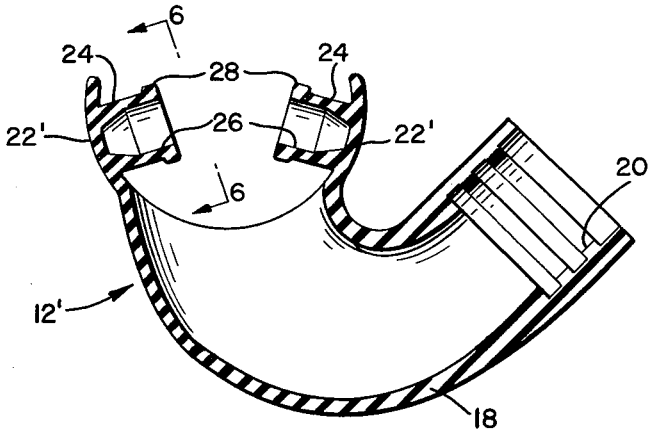
FIG. 6
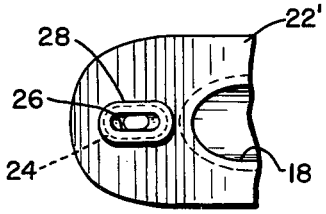
FIG. 7
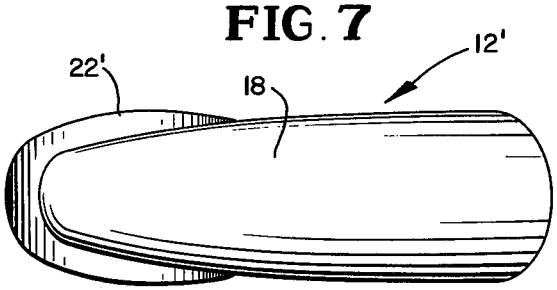

MOUTHPIECE RETAINER TABS

BACKGROUND OF THE INVENTION

Since the earliest days in the development of suitable mouthpieces for an underwater breathing apparatus such as a snorkel, regulator or the like, comfort for the user has been a paramount concern. Numerous designs ranging from the conventional to the exotic have been developed, but almost all diving equipment mouthpieces currently in use are variations of the basic design created by Rouquayrol over one hundred years ago, as disclosed in U.S. Pat. No. 59,529. The mouthpiece therein disclosed includes a vertical flange surrounding the end of the breathing tube and configured to be retained between the teeth and the inside of the lips of the user and a pair of horizontally projecting tabs h,h, situated on either side of the breathing tube opening and gripped by the teeth of the user. 80 years later, the Cousteau-Gagnon "Aqualung" as shown in U.S. Pat. No. 2,485,039, included a mouthpiece which was basically the same as Rouquayrol's.

A similar mouuthpiece designed for use with a respirator employed in a gas medium, rather than a liquid medium, is illustrated in U.S. Pat. No. 1,266,410, issued to Conrad.

Significant variations of this basic mouthpiece design have been developed, but remain relatively unpopular. In one case, the projecting, teeth engaged tabs have been replaced by an oblong or eliptical bite tube surrounding the end of the breathing tube opening, as disclosed in U.S. Pat. No. 2,839,053. A vertical rib may be inserted to prevent collapse of the bite tube when engaged by the teeth, such as is disclosed in U.S. Pat. No. 3,106,916. This particular design has not been widely adopted perhaps because of eventual discomfort to the user. Specifically, the jaws of the user remain pried apart to an unnaturally wide disposition when such a mouthpiece is being used. Additionally this mouthpiece is engaged by the incisors and canines of the user, these being teeth which are not really suited for a load bearing function, rather than the molars which are far better positioned and adapted for a gripping, load bearing function.

Another design never widely adopted was a mouthpiece without any teeth engaged retainer at all, the thought being that a vertical flange between the lips and the teeth would be sufficient to hold the mouthpiece in place while eliminating jaw fatigue. A major problem with this design is that the facial muscles are just too weak to retain the bulk of the mouthpiece comfortably. Thus, excessive facial strain and discomfort soon result.

Improvement of the basic mouthpiece design, such as disclosed by Rouquayrol, has yielded better results. One of the more significant improvements in the art is disclosed and claimed in my prior U.S. Pat. Nos. 3,844,281 and 3,929,548. These patents disclose a mouthpiece having moldable, thermoplastic retainer tabs that are heated to a plastic state and then gripped by the teeth of the user whereupon the material quite readily and permanently conforms to the dental impression of the user. This yields a very comfortable mouthpiece for that user, but such a mouthpiece may subsequently be used only by that user (unless the moldable inserts are replaced). Also, the required initial exercise to custom-fit the retainer tabs to the teeth of the user is a delicate one requiring some skill to accomplish entirely satisfactorily. Furthermore, such a mouthpiece is relatively more expensive than conventional mouthpieces and thus its widespread adoption is resisted by the cost-conscious consumer.

The present invention overcomes these problems by providing a mouthpiece have collapsible retainer tabs that readily conform to an approximate dental impression of the user and thus the mouthpiece will not unduly fatigue the jaws of the user.

SUMMARY OF THE INVENTION

Accordingly, it is a principal object of the invention to provide a mouthpiece for use with breathing apparatus such as a snorkel or the like having projecting tabs arranged for engagement by the molars of the user, each tab having a central bore therein so that the tab readily collapses to an approximate dental impression of the user.

It is another object of the invention to provide a mouthpiece having teeth engaged tabs that need not be custom fitted to the teeth of the user yet will be very comfortable in use and not unduly fatigue the user.

It is a further object of the invention to provide a mouthpiece for use with a breathing apparatus made of readily molded, pliable material such as neoprene and having integral, one piece teeth engaged tabs formed thereon, each tab being readily collapsed when engaged by the teeth of the user yet returning to an undeformed configuration after use.

Further novel features and other objects of this invention will become apparent from the following detailed description, discussion and the appended claims taken in conjunction with the accompanying drawings.

BRIEF DESCRIPTION OF DRAWINGS

Preferred structural embodiments of this invention are disclosed in the accompanying drawings in which:

FIG. 4 is a top view of a modified mouthpiece, drawn to full scale;

FIG. 5 is a section view taken along lines 5—5 of FIG. 4;

FIG. 6 is a partial section view taken along lines 6—6 of FIG. 5; and FIG. 7 is a bottom view of the snorkel shown in FIG. 4, and is also drawn to full scale.

DESCRIPTION OF THE PREFERRED EMBODIMENTS

Figure 1:
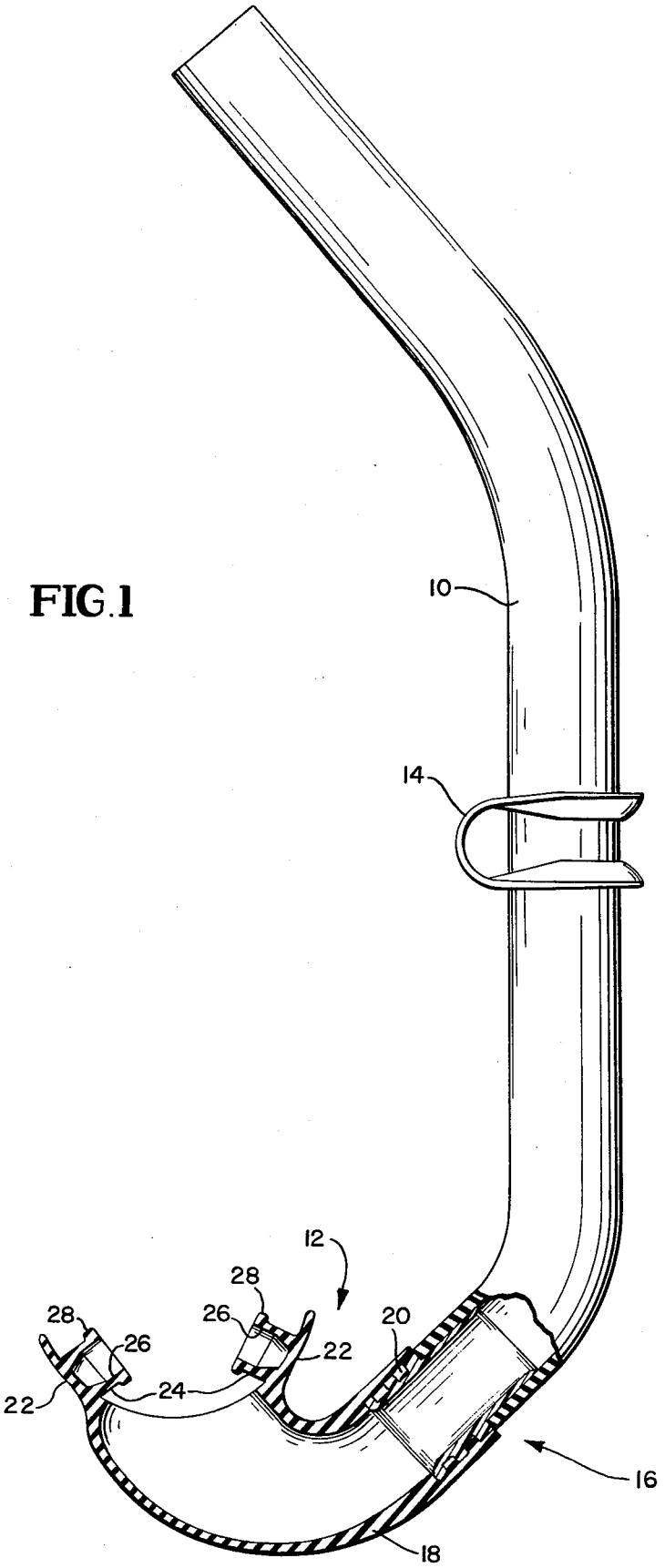
FIG. 1 is a full elevation view of a snorkel constructed according to the present invention, portions thereof being in section to reveal interior detail and drawn to a reduced scale.

A snorkel 10 is illustrated in FIG. 1 having a mouthpiece 12 and a snorkel keeper 14, through which the retainer strap of a diving mask is inserted (not shown) to retain the snorkel with such a mask on the diver's head. Of course, the mouthpiece under discussion may be constructed to serve as the mouthpiece of a regulator (not shown) or other suitable breathing apparatus.

Mouthpiece 12 is attached to snorkel 10 by a swivel connection 16 which is a tube segment made of nylon or the like and having a circumferentially grooved exterior cooperating with a matingly grooved interior of the breathing tube 18 of mouthpiece 12, as shown at 20 in FIG. 1. This construction is now more or less conventional and permits the adjustment of mouthpiece 12 to suit the comfort of the user, or diver.

At an end of the breathing tube 18 opposite swivel 16 is formed a peripheral flange 22 which per se is conventional, being adapted to fit between the lips and front surfaces of the teeth of the user. Flange 22 has a pair of tabs 24 formed integrally thereon and each tab 24 is centrally bored at 26. When mouthpiece 12 is inserted in the mouth of the user, tabs 24,24 are engaged and gripped by the molars of the user and thus are readily collapsed to more or less conform to the dental impression of the user. In a perferred embodiment, the entire mouthpiece 12 is molded as a one-piece, integral unit of neoprene or other suitable, flexible material which possesses sufficient elastic memory so that tabs 24,24 return to their approximate initial, undeformed configuration after use.

Each tab 24 is open to the ambient atmosphere so that the configuration of bore 26 remains the same regardless of changing and varying external, ambient pressures. Each tab 24 may further include a peripheral lip 28 which further secures the mouthpiece in the mouth of the user by being retained against the insides of the user's molars.

Figure 2:
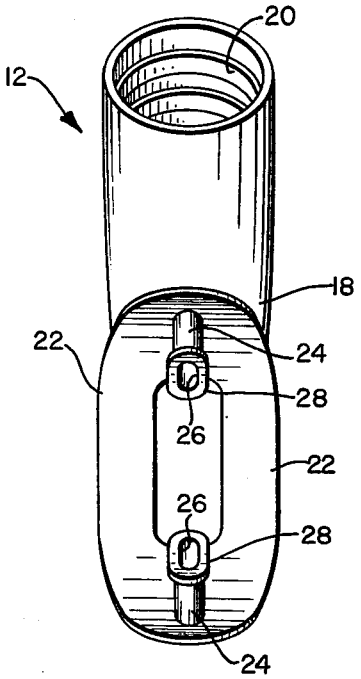
FIG. 2 is a top plan view of the mouthpiece of the snorkel shown in FIG. 1, and drawn to full scale.
Figure 3:
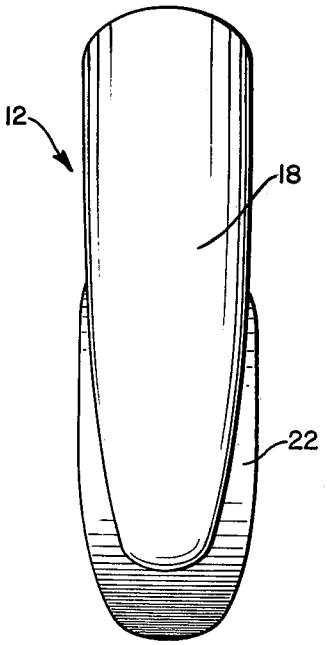
FIG. 3 is a bottom view of the mouthpiece of FIG. 2 and is also drawn to full scale.

The invention illustrated in FIGS. 4–7 is in all respects similar to that shown in FIGS. 1–3 except that flange 22' has a small radius of curvature so that mouthpiece 12' fits smaller mouths.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. For use with a breathing apparatus, a mouthpiece comprising means defining a breathing tube having an end, flange means about said breathing tube end for insertion between the lips and the outer surfaces of the teeth of a user and a pair of teeth engageable collapsible tab means for insertion between essentially the molars of the user, said tab means being mounted on said flange means on either side of said breathing tube end, each of said tab means including means defining a central bore therein whereby upon engagement of said tab means by the teeth of a user, said tab means readily collapses and flattens to an approximate dental impression of the user, said each tab means being constructed of material having sufficient elastic memory to return to a substantially undeformed configuration after use.

2. The mouthpiece as claimed in claim 1 wherein said each tab means further includes an end opposite said flange means and a peripheral lip formed about said end which is adapted to engage the rearward edges of the molars when said tab means are engaged by the teeth of a user.

3. The mouthpiece as claimed in claim 1 wherein said flange means are formed in a curved configuration to approximate the curvature of the mouth of the user, each said central bore being open to the ambient atmosphere.

4. The mouthpiece as claimed in claim 1 further comprising, in combination, a snorkel tube attached to said breathing tube at an end opposite the mounting of said flange means.

5. The mouthpiece as claimed in claim 1 wherein said flange means and said pair of tab means are formed as an integral, one-piece unit of pliable material.

6. The mouthpiece as claimed in claim 5 wherein said material is neoprene.

* * * * *